United States Patent [19]

Kozam

[11] Patent Number: 4,821,924

[45] Date of Patent: Apr. 18, 1989

[54] FLEXIBLE CONTAINER HAVING A COMPRESSION LIMITING DEVICE

[76] Inventor: George Kozam, 234 Clinton Ave., Tenafly, N.J. 07670

[21] Appl. No.: 877,105

[22] Filed: Jun. 23, 1986

[51] Int. Cl.[4] ..... B65D 1/32

[52] U.S. Cl. ..... 222/211; 222/23; 222/81; 222/212; 222/282

[58] Field of Search ..... 222/211, 212, 213, 282, 222/567, 23, 41, 81; 239/327; 433/89, 90; 604/117, 204, 212, 213

[56] References Cited

U.S. PATENT DOCUMENTS

| | | | |
|---|---|---|---|
| 1,274,081 | 7/1918 | Riethmueller | 604/117 |
| 4,099,655 | 7/1978 | Por | 222/211 |
| 4,217,897 | 8/1980 | Sneider | 604/216 X |
| 4,217,994 | 8/1980 | Koenig et al. | 222/212 |
| 4,286,735 | 9/1981 | Sneider | 222/211 X |
| 4,340,157 | 7/1982 | Darner | 222/212 X |
| 4,349,134 | 9/1982 | Schuster | 222/212 |
| 4,513,891 | 4/1985 | Hain et al. | 222/213 |

FOREIGN PATENT DOCUMENTS

| | | | |
|---|---|---|---|
| 208513 | 4/1960 | Austria | 222/211 |
| 682333 | 3/1964 | Canada | 222/211 |
| 1377258 | 9/1964 | France | 222/213 |
| 588081 | 1/1959 | Italy | 222/213 |

*Primary Examiner*—Kevin P. Shaver

*Attorney, Agent, or Firm*—Roger S. Thompson

[57] ABSTRACT

The invention is directed to disposable dispensing apparatus having a generally triangular body, for dispensing a material therefrom. A stop is disposed within the body, and has a variable thickness. The stop is positioned so that a user of the apparatus may squeeze opposing sides of the body at varying points to dispense varying amounts of the material. Preferably, indicia, such as frets, are disposed on the exterior of the body, to advise the user of the amount of material dispensed by squeezing the body at varying points along the stop. In a preferred embodiment, the body includes a one-way valve for permitting the influx of ambient air into the body after the dispensing of material therefrom, thereby maintaining the volume within the body at a relatively constant level. In a second preferred embodiment, the apparatus further includes a removable nozzle for locating a precise location into which the material is deposited upon exiting the apparatus. The nozzle may include a second one-way valve for preventing reflux into the body.

16 Claims, 3 Drawing Sheets

FLEXIBLE CONTAINER HAVING A COMPRESSION LIMITING DEVICE

BACKGROUND OF THE INVENTION

The present invention relates to dispensing apparatus, and, more particularly, to portable dispensing apparatus for dispensing periodontal medicaments, and irrigating periodontal pockets.

In the field of dispensing apparatus, it is often necessary to provide for the dispensing of varying metered amounts of a material. For example, it may be necessary to dispense different amounts of a solvent to dissolve varying levels of clogging material in a tube, or dispense difference amounts of lubricant to handle different types of machinery. All such applications have a common problem: Pre-determined amounts of a material from a single portable apparatus.

Portable apparatus exist for dispensing materials, but they have some drawbacks in certain applications. Metering of the amount of materials dispensed is sometimes difficult, for example.

A second problem with known apparatus is that of reflux, i.e. the return of material through the exit of the apparatus after the material has left the apparatus. This problem is especially acute in the field of periodontal irrigating apparatus, to which field the instant invention is particularly directed, in that the material which may reflux back into the apparatus may carry bacteria or crevicular fluids that contain contaminants.

Many portable dispensing apparatus are known, for example those disclosed in my own co-pending application, Ser. No. 864,034, filed May 15, 1986, and U.S. Pat. Nos. 4,109,653, 4,367,737, 4,381,778 and 4,512,769, each issued to Kozam et al.

Each of the referenced U.S. patents and application is directed to a multiple-barrel dispensing apparatus.

However, it is often necessary to utilize a single-barrel apparatus, i.e. one that dispenses only a single material therefrom. In these instances, it is merely necessary that the apparatus be relatively simple, and even perhaps disposable.

Such apparatus must be simple and inexpensive to manufacture. In addition, it would be preferable for the apparatus to be usable by more than one member of the same household, much as a tube of toothpaste may be used by an entire household. This desire is difficult to achieve, however, due to the reflux problem discussed above, since any dispensing of a material into a periodontal pocket may permit the reflux of contaminated crevicular fluids back into the dispensing apparatus.

My own U.S. Pat. No. 4,575,375 is directed to an apparatus for dispensing medications from a tube into periodontal pockets. This apparatus is useful in delivering medications from known containers in the form of tubes, but may not be useful in all applications. This device avoids the drawbacks of many prior art devices, but still does not meet all criteria for all situations.

There still exists a need for a simple and inexpensive apparatus for the dispensing of periodontal irrigating materials, that is capable of use by several members of the same household without the risk of cross-contamination.

OBJECTS AND SUMMARY OF THE INVENTION

Accordingly, it is an object of the invention to provide a portable dispensing apparatus which overcomes the drawbacks of the prior art.

It is a further object of the invention to provide a portable dispensing apparatus which easily dispenses variable metered amounts of a material contained therein.

It is a still further object of the invention to provide a portable dispensing apparatus which has improved reflux avoidance capabilities.

It is a still further object of the invention to provide a portable periodontal pocket irrigator which may be used by several members of the same household with reduced risk of cross-contamination.

It is a still further object of the invention to provide a removable nozzle for a periodontal pocket irrigator as described.

Briefly stated, there is provided a disposable dispensing apparatus having a generally triangular body, for dispensing a material therefrom. A stop is disposed within the body, and has a variable thickness. The stop is positioned so that a user of the apparatus may squeeze opposing sides of the body at varying points to dispense varying amounts of the material. Preferably, indicia, such as frets, are disposed on the exterior of the body, to advise the user of the amount of material dispensed by squeezing the body at varying points along the stop. In a preferred embodiment, the body includes a one-way valve for permitting the influx of ambient air into the body after the dispensing of material therefrom, thereby maintaining the total volume within the body at a relatively constant level. In a second preferred embodiment, the apparatus further includes a removable nozzle for locating a precise location into which the material is deposited upon exiting the apparatus. The nozzle may include a second one-way valve for preventing reflux into the body.

In accordance with these and other objects of the invention, there is provided a portable dispensing apparatus for dispensing a material contained within the apparatus, said apparatus comprising: a body member having a lower portion; varying stop means disposed within the body member; exit means disposed at an outer surface of the body member; and a conduit for carrying the material from the body to the exit means.

According to feature of the invention, there is further provided a nozzle for a dispensing apparatus, the dispensing apparatus containing a material that is to be dispensed, the nozzle comprising: securing means for removably securing the nozzle to the apparatus; exit means for dispensing the material; a conduit having a first end proximate the securing means, and a second at the exit means; and a one-way valve disposed within the conduit, for permitting the one-way flow of the material from the apparatus to the exit means.

According to a still further feature of the invention, there is still further provided a portable dispensing apparatus, for dispensing a material, the apparatus comprising: a body member having an exterior and an interior, the material being disposed within the interior of the body, the body member also having a lower portion; first exit means leading to the exterior of the body; a first conduit leading from the lower portion to the first exit means; a first one-way valve on the exterior of the body member, for permitting the introduction of ambient air from the exterior of the body member into the interior thereof; varying stop means disposed within the interior of the body member; a nozzle; the nozzle including securing means for removably securing the nozzle to the first exit means; the nozzle also including a second exit means, for dispensing the material; the nozzle further including a second conduit leading from the first exit means to the second exit means; and the nozzle further including a second one-way valve disposed within the second conduit.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
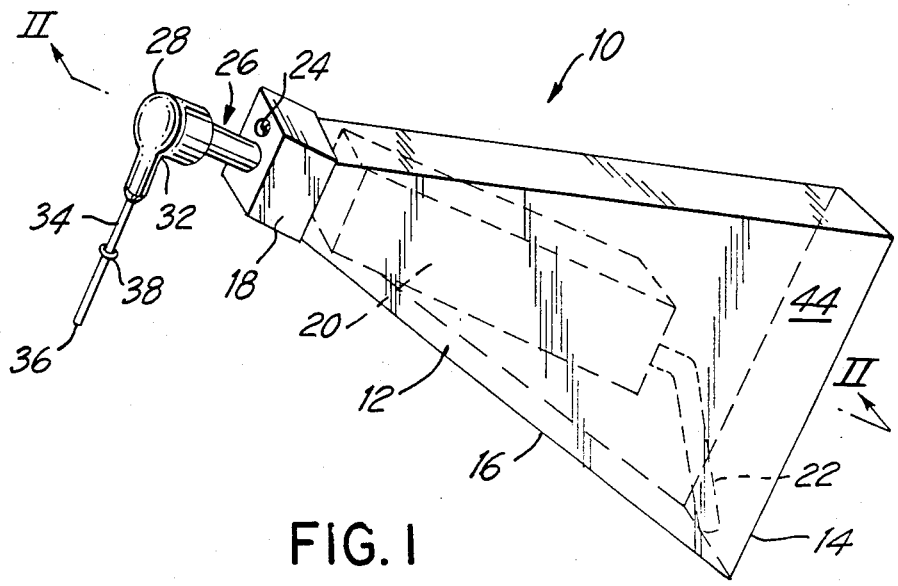
FIG. 1 is a perspective of a dispensing apparatus made in accordance with a preferred embodiment of the invention, with certain interior components thereof shown in phantom.

Referring now to FIG. 1, there is shown, generally at 10, a dispensing apparatus, in accordance with the invention.

Dispensing apparatus 10 includes a body 12, having a lower portion 14, a main body 16, and a cap 18. A variable stop 20 runs generally centrally through main body 16, and carries a first conduit 22 therein.

Cap 18 includes a first one-way valve 24, disposed to permit air from outside dispensing apparatus 10 to enter therethrough, but not permit any material from within cap 18 to exit therefrom. A first securing means 26 is affixed to the front of cap 18.

Preferably, main body 16 has a generally triangular shape, with equal volumes disposed above and below first conduit 22. This is not necessary, however, and main body 16 may have any desired shape, such as having a rounded lower portion 14 or have no volume above first conduit 22. It is strongly preferred, however, that main body 16 have a portion which is lower than the rest of main body 16 when dispensing apparatus 10 is in operation (as described in greater detail below), so that any material (not shown) contained therein will tend to flow to lower portion 14, thereby permitting the collection thereof by first conduit 22 in a manner to be described. Additionally, the precise dimensions of main body 16 are not critical to its utility, and may be a matter of design choice.

It is preferred, however, that main body 16 be made of a resilient material, such as a polypropylene, which remembers its shape after it is deformed.

Figure 2:
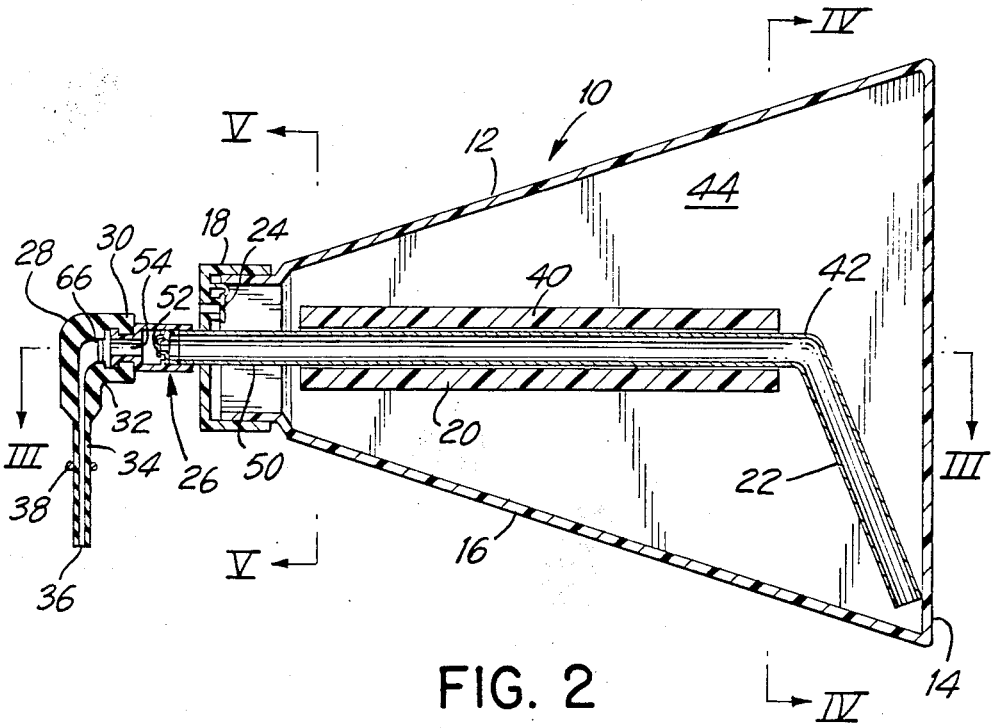
FIG. 2 is a cross-section of the embodiment of FIG. 1, taken along lines II—II thereof.

Referring now also to FIG. 2, a nozzle 28 is removably secured to first securing means 26 through a second securing means 30. First and second securing means 26 and 30 are complementary in nature, and may be of any convenient type, such as a snap fit or a threads and groove arrangement. It is preferred, however, that nozzle 28 be freely pivotable about first securing means 26, so a secure snap fit arrangement, as illustrated, is preferred. In addition, it is also preferred that nozzle 28 be made of a flexible material.

Nozzle 28 comprises a curved body 32, and a second conduit 34 disposed therein. Second conduit 34 leads from nozzle 28 to an exit 36. A movable stop 38 is disposed about a lower end of second conduit 34. Movable stop 38 is movable along a portion of the length of second conduit 34. Second conduit 34 is preferably dimensioned to accommodate the environs in which it is intended for use. For example, in a preferred embodiment in which dispensing apparatus 10 is used for dispensing periodontal pocket irrigants, second conduit 34 has a length of approximately 2.5 cm, and may have an aperture of approximately 16–28 gauge therein. It is further preferred that exit 36 be rounded to prevent the infliction of damage in the area of use of dispensing apparatus 10.

The rounding of exit 36 may be particularly desirable in the preferred embodiment, i.e. of a periodontal pocket irrigator, in that exit 36 will be inserted directly into the periodontal pocket, which is a very tender area. By rounding exit 36, damage to this sensitive area may be at least partly avoided.

Figures 3, 3A:
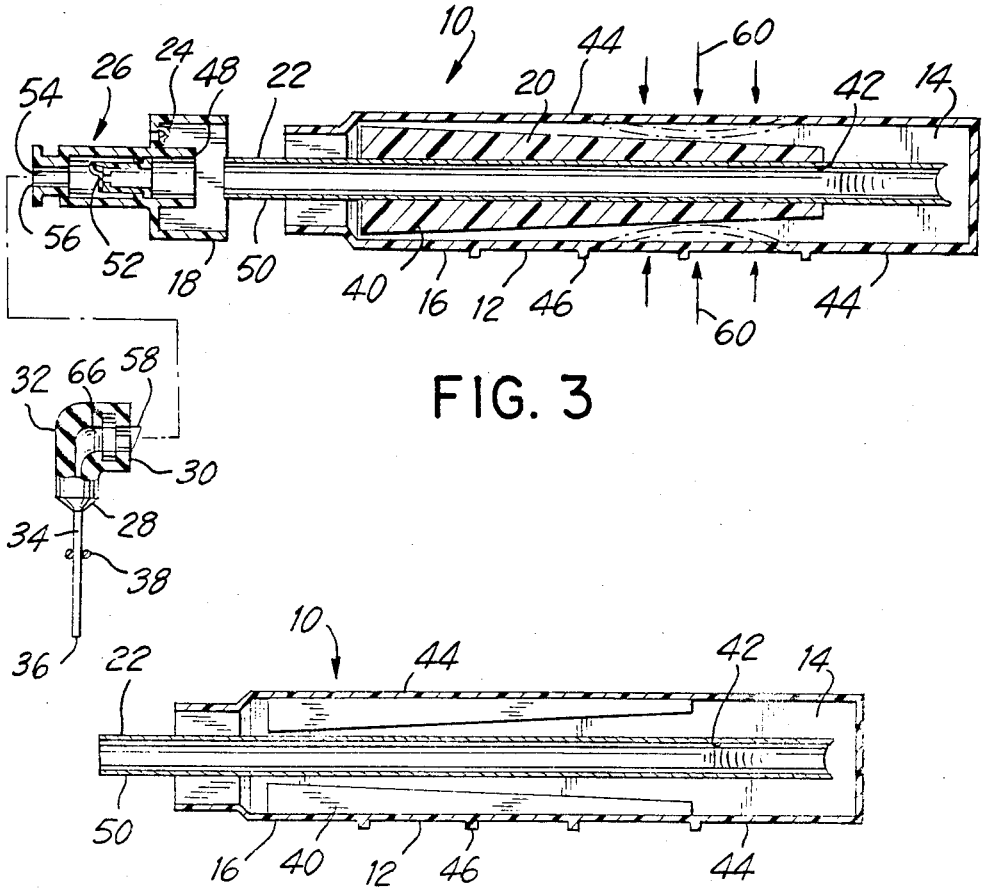
FIG. 3 is a cross-section of the embodiment of FIG. 1, taken along lines III—III thereof.
FIG. 3*a* is a cross-section of a secondary embodiment of the invention, similar to the cross-secton shown in FIG. 3.

FIG. 3 illustrates further details of the preferred embodiment. Main body 16 and cap 18 are formed as separate pieces, so that a material (not shown) which is to be dispensed by dispensing apparatus 10 may be inserted into main body 16 before cap 18 is affixed thereto.

Figure 5:
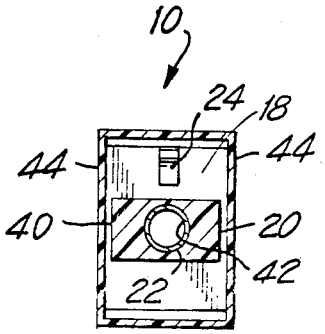
FIG. 5 is a further cross-section of the embodiment of the invention, taken along a view corresponding to that along lines V—V of FIG. 1.
Figure 4:
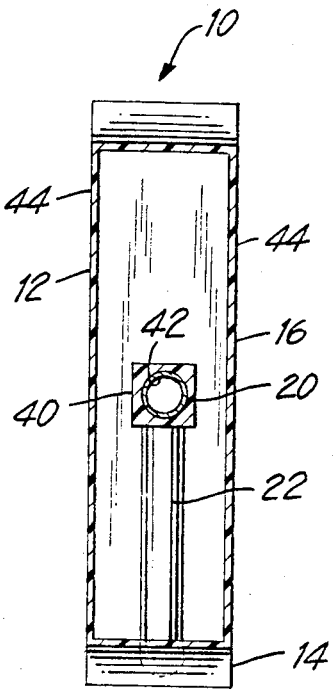
FIG. 4 is a cross-section of a second embodiment of the invention, taken along a view corresponding generally to that along lines IV≧IV of FIG. 1.

Variable stop 20 comprises a pair of opposed tapered ramps 40, having a channel 42 therebetween, in which first conduit 22 is disposed. In one embodiment (FIGS. 4 and 5), opposed tapered ramps 40 may be formed as part of a unitary block into which first conduit 22 is inserted. In a preferred embodiment, however, it is preferred that tapered ramps 40 are separate, for the easy insertion therebetween of first conduit 22. In a second preferred embodiment, tapered ramps 40 may be affixed to resilient opposing side walls 44 of main body 16. This may be the simplest of the embodiments to manufacture. As a final alternative (not shown in FIG. 2 see FIG. 3a), variable stop 20 may consist of a single tapered ramp 40' affixed to one side wall 44. That single tapered ramp 40 has channel 42 therein.

Dispensing apparatus 10 further includes indicia 46, such as frets, on at least one side wall 44. It is preferred that indicia 46 be both visible and tactilely sensible, so that they may be discerned when they are not visible.

Cap 18 includes an opening 48 for receiving an end 50 of first conduit 22. Opening 48 opens onto a second one-way valve 52, oriented to permit flow from first conduit 22 to the exterior of cap 18. Flow through second one-way valve 52 exits cap 18 through an opening 54 in first securing means 26, and then enters nozzle 28.

In an embodiment shown in FIG. 3, first securing means 26 further includes a seal 56, for protecting dispensing apparatus 10 from adulteration of the material contained therein, and nozzle 28 includes a cutting edge 58 for breaking seal 56 when dispensing apparatus 10 is to be used for the first time. In a preferred embodiment, opening 54 is a foil, and so cutting edge 58 must be of sufficient rigidity to pierce that foil. The particulars of such a design may be left to those of ordinary skill in the art, as being well within a designer's expertise.

Although dispensing apparatus 10 has general applicability to dispensing apparatus, for concreteness of description, its use is described with reference to an application as a dispenser for periodontal pocket irrigating and medicating materials.

In operation, the user first ascertains how much of the material contained within dispensing apparatus 10 he wishes to dispense, and the desired location into which the material is to be introduced. Once the positioning is certain, the user moves movable stop 38 into a position corresponding to the maximum depth of insertion of second conduit 34. This may be done by dead reckoning, or further indicia (not shown) may be provided on the exterior of second conduit 34 for identifying various depths for various applications. The proper placement of exit 36 avoids the possibility of inadvertently inflicting pain by inserting the pointed end of second conduit 34 too deeply into a periodontal pocket.

The user then locates the one of indicia 46 which corresponds to the amount desired, places his fingers on the exterior of side walls 44, and then pushes his fingers together in the direction indicated by arrows 60, thereby performing a stroke. The depth of the stroke (shown in dashed line in FIG. 3) is determined by the distance between the interior of side walls 44 and variable stop 20 at the position selected. If the stroke is to be relatively large, and a great deal of material is to be dispensed, then the selected position is near the area in which variable stop 20 is most narrow. In the illustrated embodiment, this would correspond to the rear of main body 16. It is here noted that the direction of taper of variable stop 20 is merely a matter of design choice. In fact, variable stop 20 may be stepwise variable, rather than tapered, vary in any desired pattern or at random, so long as indicia 46 correctedly identify the depth of the stroke at any particular point.

Figure 6:
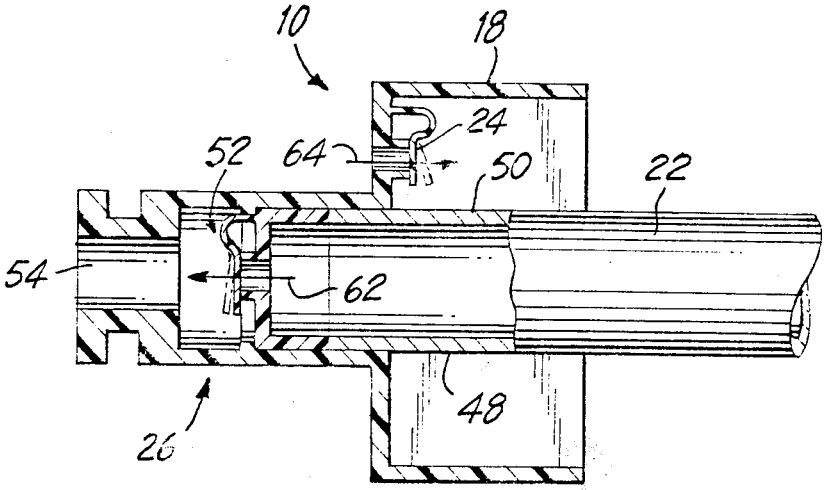
FIG. 6 is a detail of a portion of FIG. 3.

Referring now to the detail of FIG. 6, once the user depresses side walls 44, the interior volume of dispensing apparatus 10 decreases, thereby causing a pressure to force the material out of main body 16. Since main body 16 is sealed, but for the egress permitted by second one-way valve 52, the material must flow out second one-way valve 52, in the direction indicated by arrow 62 into first securing means 26, whence it continues to flow out second conduit 34 into the desired location.

Since side walls 14 are resilient, they tend to return to their original state (in solid line), thereby causing a vacuum to develop within dispensing apparatus 10. The vacuum draws air from the exterior of dispensing apparatus 10 through first one-way valve 24 in the direction indicated by arrow 64. The volume of air brought into main body 16 by the vacuum equals the volume of material expelled therefrom through second one-way valve 52, thereby maintaining the total volume within dispensing apparatus 10 constant.

The air brought into main body 16 through first one-way valve 24 tends to remain at the top of main body 16, urging the material into lower portion 14. Thus, when main body 16 becomes close to empty, the pressure on side walls 44 causes air to press downward on the material and thence up first conduit 22, and out as before. Since first conduit 22 is disposed at lower portion 14, it may thereby pick up nearly all of the material contained in main body 16, with a minimum of waste.

In addition, it is pointed out that the positioning of second one-way valve 52 within cap 18 permits the free interchange of various nozzles 28 without fear of cross-contamination therebetween, since there can be no reflux of contaminants into cap 18. For additional protection, however, there may be provided a third one-way valve 66 within nozzle 28, oriented to prevent any reflux therepast.

It is contemplated that an interruptor valve (not shown) may be inserted in the line of dispensing, i.e. either within conduit first 22 or second conduit 34. The interruptor valve would permit a discontinous flow of material to the desired area. In the preferred embodiment, this may provide a therapeutic massaging or pulsating action to the periodontal pocket, thereby soothing the tender pocket, as well as providing the benefits afford by the material introduced thereto.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Portable dispensing apparatus for dispensing a first material contained within said apparatus, said apparatus comprising:

a compressible body member having a lower portion;

varying stop means disposed within said body member for limiting the extent to which the container can be compressed;

exit means disposed at an outer surface of said body member for dispensing material; and a conduit for carrying said material from said body to said exit means.

2. Portable dispensing apparatus according to claim 1, wherein said stop means includes a tapered ramp.

3. Portable dispensing apparatus according to claim 2, wherein said body member includes at least one wall, and said stop means is affixed to said at least one wall.

4. Portable dispensing apparatus according to claim 2, wherein said tapered ramp is affixed to said exit means.

5. Portable dispensing apparatus according to claim 1, wherein said conduit has a first end disposed within said lower portion of said body member.

6. Portable dispensing apparatus according to claim 1, further comprising a one-way valve positioned on said outer surface of said body, for permitting ambient air to enter said body.

7. Portable dispensing apparatus according to claim 1, wherein said compressible made of body is flexible material and thereby permits the dispensing of said material from said body by squeezing said body.

8. Portable dispensing apparatus according to claim 1, further comprising:

indicating means disposed on said outer surface of said body for indicating varying amounts of said material which may be dispensed by said apparatus.

9. Portable dispensing apparatus according to claim 1, wherein said conduit extends through said body member and into said exit means.

10. Portable dispensing apparatus according to claim 9, further comprising:

a seal for sealing said exit means against the exterior.

11. Portable dispensing apparatus, for dispensing a material, said apparatus comprising:

a compressible body member having an exterior and an interior, said material being disposed within said interior or said body, said body member also having a lower portion;

first exit means leading to said exterior of said body;

a first conduit leading from said lower portion to said first exit means;

varying stop means disposed within said interior of said body member for limiting the extent to which the container can be compressed; and a nozzle;

said nozzle including securing means for removably securing said nozzle to said first exit means;

said nozzle also including a second exit means, for dispensing said material;

said nozzle further including a second conduit leading from said first exit means to said second exit means; and said nozzle further including a one-way valve disposed within said second conduit.

12. Portable dispensing apparatus according to claim 11, further comprising a plurality of frets disposed on said exterior of said body member for indicating a respective plurality of amounts of material dispensed by said apparatus.

13. Portable dispensing apparatus according to claim 11, further comprising a seal for sealing said first exit means from ambient air; and wherein said nozzle further includes means for breaking said seal.

14. Portable dispensing apparatus according to claim 11, wherein said stop means includes a tapered ramp disposed within said interior of said body member.

15. Portable dispensing apparatus according to claim 11, further comprising movable stop means for limiting the penetration of said second exit means into an area into which said second exit means is placed for dispensing said material.

16. Portable dispensing apparatus according to claim 11, further comprising a one-way vent valve on the exterior of said body member, for permitting the introduction of ambient air from the exterior of said body member into said interior thereof, in response to the dispensing of said material from said interior of said body member.

* * * * *